United States Patent [19]

Poesch

[11] Patent Number: 4,964,474

[45] Date of Patent: Oct. 23, 1990

[54] FLEXIBLE TUNNELING APPARATUS AND METHOD

[76] Inventor: William L. Poesch, 12213 Folkstone Dr., Herndon, Va. 22071

[21] Appl. No.: 370,221

[22] Filed: Jun. 22, 1989

[51] Int. Cl.[5] ..... E21B 7/08

[52] U.S. Cl. ..... 175/74; 175/73; 175/61; 405/154; 405/138

[58] Field of Search ..... 405/184, 138, 139, 140, 405/141, 146; 175/61, 73, 74, 62; 254/29 R

[56] References Cited

U.S. PATENT DOCUMENTS

| | | | |
|---|---|---|---|
| 2,694,549 | 11/1954 | James | 175/73 X |
| 2,726,847 | 12/1955 | McCune et al. | 175/73 X |
| 3,011,568 | 12/1961 | Grimm | 175/74 |
| 3,958,649 | 5/1976 | Bull et al. | 175/61 |
| 4,442,908 | 4/1984 | Steenbock | 175/61 X |
| 4,446,932 | 5/1984 | Hipp | 175/61 X |

*Primary Examiner*—Dennis L. Taylor

[57] ABSTRACT

A flexible tunneling apparatus has an articulated thrust rod made up of a plurality of substantially identical tubular elements having complementary end surfaces, the elements being disposed in end-to-end relation and strung on a cable which is tensioned to effectively integrate the elements to form the rod. The rod is inserted into a tubular guide member which extends axially through and along the sidewall of a shaft. At one end the tubular guide member defines a rounded 90 degree turn causing flexure of the rod and diverting it to a path perpendicular to the axis of the shaft. Repetitive thrusting and retraction of the rod create a tunnel extending radially with respect to the axis of the shaft.

14 Claims, 2 Drawing Sheets

FLEXIBLE TUNNELING APPARATUS AND METHOD

The United States Government has a paid up license in this invention and the right in limited circumstances to require the patent owner to license others on reasonable terms as provided for in the terms of the contract under which it was made.

This invention relates generally to earth boring and tunneling apparatus and methods and, in particular, to boring apparatus and methods capable of making a relatively small secondary bore extending laterally from a larger primary shaft created by conventional means and techniques. While in the exemplary embodiments of the invention described herein the primary shaft is vertical, it will be recognized that it may be of any orientation; the lateral bore, however, extends at least substantially perpendicular to the axis of the primary shaft.

In one of its principal fields of application, the invention is directed toward the formation of subterranean passages running laterally from the preexisting vertical shaft or bore of an oil well. After a period of months or years of operation, many oil wells experience a drop in productivity so profound as to render further operation economically unwarranted despite the fact that large quantities of oil remain in the well. This condition is brought about by accumulations of paraffin which block the lateral flow of oil.

With the increased price of oil and the chronic threat of shortages or disruption of supply from foreign sources, much attention has been given to the problem of restoring paraffin-blocked wells to economically feasible productivity. Insofar as is known, the only technique that is available at present involves lowering into the well a device for firing 1 inch steel balls radially with respect to the axis of the well bore through the casing and the paraffin blockage. This approach to the problem is of limited usefulness: available information is to the effect that the maximum lateral penetration achieved in this manner is about 18 inches, leaving much to be desired insofar as completely unblocking the well is concerned.

Another important application of the invention is in connection with laying underground utilities pipe, conduits for electrical cables, etc. At present this is done either by trenching, which is sometimes undesirable because of the disruption of the surface that is involved—a particular problem where it is necessary to cross a roadway or sidewalk—or by drilling or ramming, which requires a starting trench at least slightly deeper than the level at which it is desired to lay the conduit and collinear therewith. In order to accommodate a substantial length of rigid conduit and the drilling or ramming equipment, the trench typically must be from 10 to over 30 feet long.

The need for a starting trench is avoided by apparatus commercially known by the proprietary designation "Ditch Witch". This apparatus employs a rotary drill having a steerable nose which controls the direction of the drill both as to depth and azimuth. The nose of the drill shaft is introduced into the earth at a shallow angle and guided to the desired depth by the control means. As the slope of the bore is necessarily gradual, the nose must be started at a considerable distance from the point at which the desired tunnel depth is reached. Thus, while the digging of a starting trench is avoided, this type of apparatus is not useable where there is not a substantial open space available at the starting point of the drill. Consequently, it would not be possible using either conventional ramming or the guided rotary tool to create a tunnel extending outwardly from a building wall, for example, as will shown presently in the course of this description.

With the present state of the art in view, it is the basic general objective of the present invention to overcome or at least mitigate the disadvantages and shortcomings outlined above.

A specific object of the invention is to provide methods and apparatus capable of boring lateral subterranean passages extending at least about 100 inches from a preexisting primary shaft.

Another object of the invention is the provision of methods and apparatus for ramming subterranean conduits without the need for long collinear starting trenches or unobstructed fields of operation.

Still another object is to provide methods and apparatus as in the preceding object which enable ramming such conduits at any reasonable depth from a primary shaft only about 30 inches in diameter.

BRIEF DESCRIPTION OF THE INVENTION

To the fulfillment of the foregoing and other objects, the invention contemplates apparatus for boring laterally extending subterranean passages including an elongate articulated thrust rod comprising a plurality of generally tubular or prismatic elements having complementary bearing surfaces at their respective ends. For literary ease the elements will hereinafter the referred to as being "tubular"; it is to be understood, however, that this term is being used generically and encompasses "prismatic" unless foreclosed by the context.

When in operative correlation, the elements are disposed with their complementary end surfaces in contact. A cable strung through the elements is secured to the endmost elements. Means are provided for exerting a tensile force on the cable of sufficient magnitude to maintain said elements in normally rigid coaxial relation to form the articulated rod while permitting flexure of the rod in response to an applied lateral force of sufficient magnitude. In other words, the rod is flexible enough to make a 90 degree band as will be shown presently and yet rigid enough to resist buckling when functioning to drive a nose piece.

BRIEF DESCRIPTION OF THE DRAWINGS

FIG. 8 is a vertical section of a shaft proximate to a building foundation creating a situation for another particular embodiment of the invention, viz., the horizontal ramming of conduits for utilities and the like;

DESCRIPTION OF PREFERRED EMBODIMENTS

Figure 2:
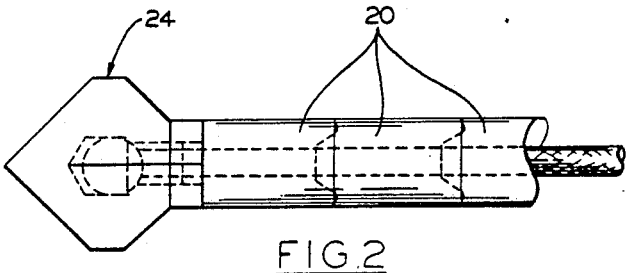
FIG. 2 is an enlargement of a fragment of FIG. 1, viz., the left hand end of the horizontally extending portion.
Figure 1:
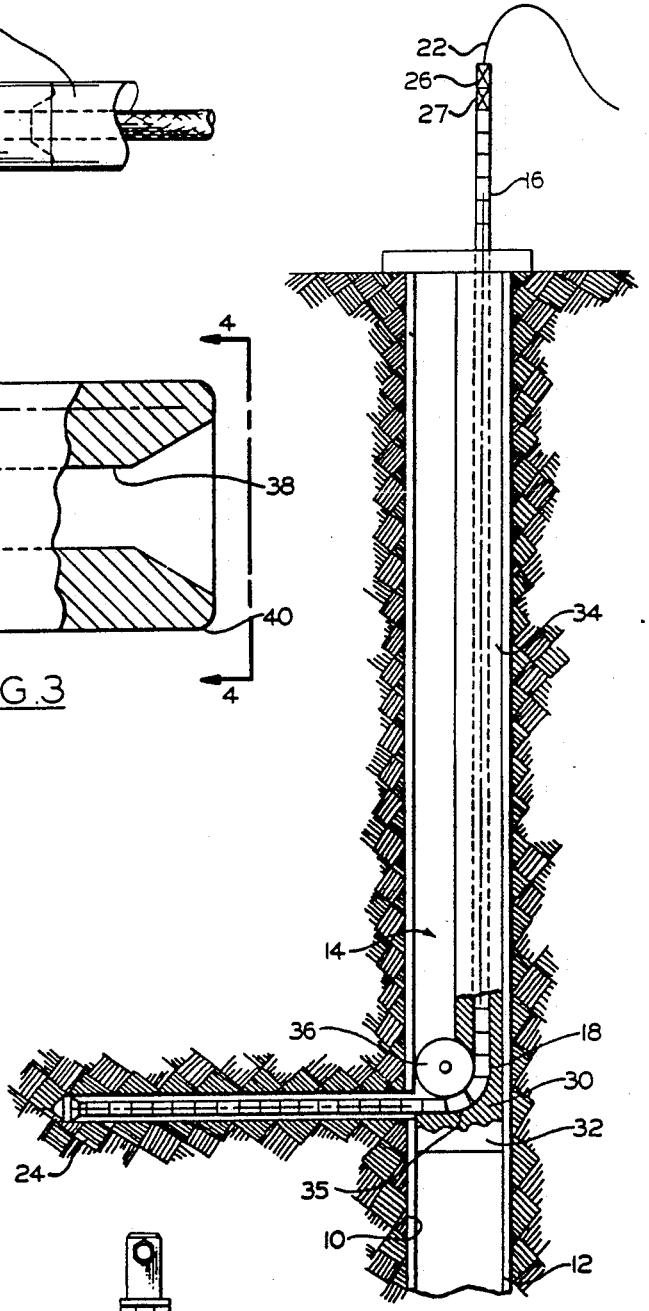
FIG. 1 is a schematic illustration of one embodiment of the invention shown in a vertical section.

Referring now to the drawings and first, in particular to FIGS. 1 and 2, there is shown a vertical shaft or bore 10 of indeterminate length extending into the earth. The shaft may be the bore made by an oil drilling rig in which case there customarily would be a well casing such as shown at 12.

Extending downwardly along one sidewall of casing 12 is a flexible thrust rod assembly designated generally by reference numeral 14 and made up of an articulated thrust rod 16 and an insertion tool 18. Thrust rod 16 consists of a plurality of generally tubular elements 20 which will be described in greater detail presently.

Elements 20 are disposed end-to-end in coaxial alignment and are maintained in such disposition by a steel cable 22 threaded through the elements. One end of the cable is secured to a nose piece 24 (FIG. 2) having lateral dimensions equal to or greater than those of elements 20; at the other end a pair of collets 26, 27 are tightened on the cable after it has been tensioned by any suitable means, such as the device 28 shown in FIGS. 5 and 6. Thus elements 20 are subjected to a compressive force applied between nose piece 24 and collets 26, 27.

Insertion tool 18 includes a corner block member 30 which is positioned at the desired level in shaft 10. At least a portion 32 of member 30 conforms to and is a tight fit in well casing 12. In a practical embodiment of the invention means preferably are provided for wedging or otherwise locking the corner block member in the shaft. The remainder of the insertion tool consists of an elongate tubular guide member 34 extending upwardly from block member 30 to the surface and a guide wheel 36 mounted in member 30 for rotation about an axis perpendicular to a plane through the longitudinal axis of the guide member.

The space between guide wheel 36 and corner block 30 is just sufficiently larger than the outer diameter f elements 20 to allow the elements to slide freely past the guide member.

Corner block member 30 contains a 90 degree elbow shaped passage 35 of essentially the same cross section as the interior of guide member 34; one end of the passage opens upwardly in alignment with the lower end of guide member 34 and the other end extends radially with respect to the axis of the guide member.

The thrust rod is threaded through the insertion tool 18 prior to tensioning of cable 22. As will be described in connection with a particular embodiment of the invention, means are provided to drill a hole in the well casing slightly larger in diameter than the nose piece 24. With the bit positioned in alignment with the hole, the cable is tensioned as previously described, in effect integrating the individual elements into a rigid rod which nevertheless is capable of flexure by means of the lateral force exerted as the rod passes through the rounded 90 degree elbow in corner block 30.

Figure 3:
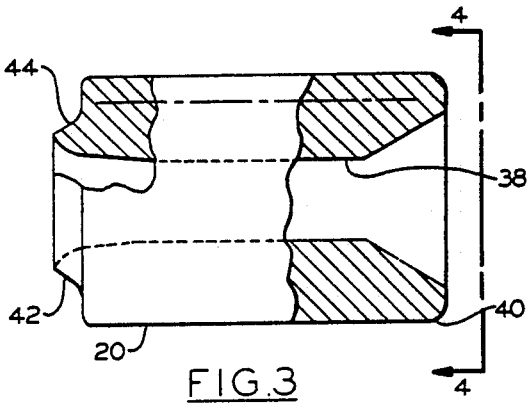
FIG. 3 is an elevational view, partly in section, of a single element of the articulated rod of FIG. 1 shown on an enlarged scale.
Figure 4:
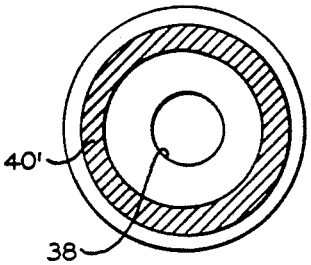
FIG. 4 is an end view of FIG. 3 looking in the direction of the arrows.

The flexure of rod 16 is enabled by the configuration and nesting engagement of elements 20 as will now be described with particular reference to FIGS. 3 and 4. The elements may be fabricated of any suitable material such as, for example, aluminum or stainless steel. The choice would depend on the forces which would need to be borne in a particular application. In some cases steel would be used for the elements which pass through the corner block, encountering severe stress in doing so, and aluminum for the remaining elements.

In the embodiment being described, each of the elements is of cylindrical configuration and has a coaxial through bore 38. At one end, the right-hand end as viewed in FIG. 3, bore 38 flares outwardly to merge into one end of a radius 40 of about 135 degrees the other end of which merges into the external (cylindrical) surface of the element. Thus, the radiused end of the element defined an annular bearing surface represented by the shaded area 40' in FIG. 4.

The opposite end of the element is of complementary configuration: an annular ridge 42 concentric with the bore 38 has a diameter smaller than that of bearing surface 40 and is surrounded by a coaxial concave or internally radiused bearing surface 44 which engages the complementary surface 40 on the end of the adjoining element when they are disposed end-to-end.

The bearing surfaces are preloaded against each other by the tension in cable 22; the tension remains essentially constant as the elements run through the 90 degree turn in corner block member 30, the relaxation of the cable by the exiting elements being offset by the increase in tension caused by the entering elements. Consequently, overstressing of the cable is avoided and the stiffness of the thrust rod is maintained on both sides of the bend. The important interaction and relative movement between the cable and the elements are achieved by the contour of the through bore 38 and the end faces of the elements.

Figure 5:
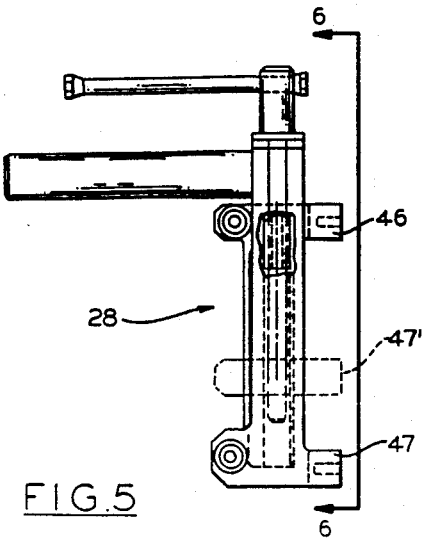
FIG. 5 is an elevational view of a device useful in connection with the invention.
Figure 6:
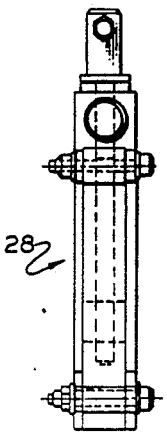
FIG. 6 is an elevational view of the devide of FIG. 5 looking in the direction of the arrows.

While any type of device may be employed to tension the cable, one satisfactory tool 28 is shown in FIGS. 5 and 6. The tool consists of telescoped members each having a collet grip 46, 47 adapted to engage one of the two collets 26, 27.

Collect grip 46 is threadedly engaged on a rotatable shaft carrying complementary threads in the manner of the jaws of a bench vise albeit the operative force is exerted in the opposite direction, i.e., instead of the jaws/collet grips coming together relative to one another to grip an article, they spread so as to force the collet grips apart. In FIG. 5, collet grip 47 is shown in broken lines at 47' which represents its position relative to collet grip 46 prior to tensioning cable 22. During the cable tensioning procedure, the uppermost collet member 26 is locked tightly on cable 22 and the collet 27 is loosened and bears against the upper end of the string of elements 20. After the cable has been stretched to the desired tension, it is maintained by tightening collet 27. Collet 26 is then repositioned adjacent collet 26 and locked to the cable to provide assurance against slippage.

Figure 7:
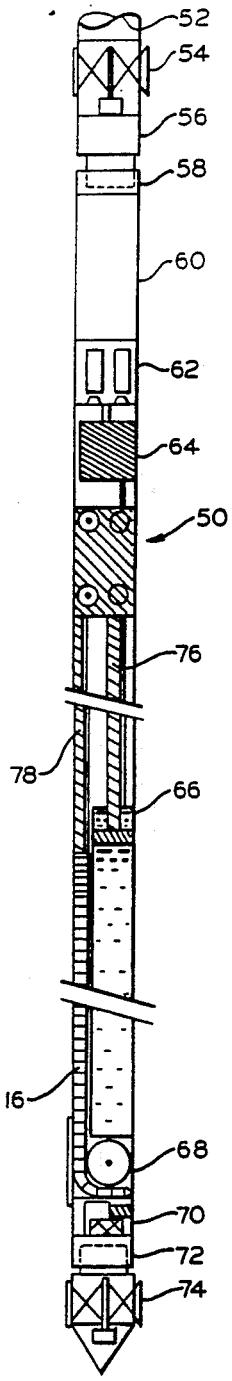
FIG. 7 is a vertical sectional view showing the invention in a particular embodiment adapted for use in the recovery of paraffin-blocked oil wells.

A detailed embodiment of the invention in a modular remote controlled tool 50 adapted specifically for oil well renewal is shown in FIG. 7 wherein parts in common with those previously described are designated by the same reference characters. Tool 50 is mechanically attached to a specially modified section of drill stem and lowered to the desired depth in the well by means of conventional oil well equipment. Attached to a conventional drill stem shown fragmentally at 52, tool 50 consists of the following modular sections designated by reference numerals in sequence from top to bottom:

54 Upper expander section
56 Remote control and actuation system
58 Upper telescoping section/Axial positioner
60 Power pack
62 Clocking mechanism
64 Electrically-driven hydraulic pump
66 Hydraulic cylinder/piston
68 Corner block member
70 Drill
72 Lower telescoping section
74 Lower expander section Inasmuch as the individual components of the tool are, per se, well known in the art, it will not be necessary to describe them in detail. Accordingly, a brief description of the function and interaction of the components will suffice.

Upper and lower expander units 54 and 74, are electrically operable to radially expand against the walls of the well casing and thus lock the tool in the selected axial position. Upper and lower telescoping sections 58 and 72 are jointly operable to axially displace the center section, i.e., the group of modules (60, 62, 64, 66, 68, and 70) between them, relative to the fixed expander sections 54 and 74. The remote control/actuation system 56 permits all functions to be controlled from the surface. Upper telescoping section and axial positioner 58 displaces thrust rod 16 vertically so as to align the nose piece 24 with the previously drilled hole in the casing.

Power pack 60 supplies power for electirc motor and hydraulic pump 64. Clocking mechanism 62 precisely indexes the center section and, concomitantly, drill 70, nose piece 24 and the thrust rod to permit drilling of a number of angularly spaced holes in the well casing and then aligning the nose piece with the holes. The well known mechanism usually referred to as a harmonic drive is well suited to this function.

Hydraulic pump 64 electrically driven by power supplied by power pack 60 delivers the hydraulic working medium to hydraulic cylinder/piston assembly 66. The piston rod 76 is coupled via an elongate member 78 to the articulated thrust rod and imparts reciprocatory motion thereto. The length of the stroke is determined by the length of the piston travel in the cylinder. Coupling member 78 extends parallel to the axis of the well bore as does thrust rod 16 until it is diverted 90 degrees to a horizontal path by the corner block 68.

As previously mentioned, radial holes are made in the well casing by a drill which is adjusted by the upper and lower telescoping sections 58 and 72 to the desired height and is angularly oriented by index section 62. When the holes have been drilled, the telescoping sections lower the center section to align the nose piece 24 on the end of the segmented thrust rod with the newly drilled hole. The lower expander 74 locks the lower end of the modular unit against radial and longitudinal displacement.

Briefly recapping the operation of the apparatus of FIG. 7, electrically powered pump 64 and hydraulic cylinder/piston 66 coact to force the thrust rod downwardly and radially to create a flow path for oil. The pressure of the hydraulic working fluid is then reversed, retracting the piston to the starting position. Harmonic drive 62 is then activated to clock the movable center portion of the tool in predetermined angular increments. The use of 20 degree increments, for example, would result in repetition of the operation to create 18 flow paths for oil at a given depth. The expanders could then be retracted and the tool raised or lowered to permit the creation of another series of flow paths.

Another embodiment of the invention is especially adapted for use in ramming subterranean pipes or other conduits in situations where it is impossible or undesirable to dig a starting trench. As a matter of fact, even where there is no condition precluding the use of a starting trench (typically 10 to 30 feet or more in length) it is frequently preferably from the standpoint of the labor involved and the attendant degree of disruption to use the apparatus and techniques contemplated by the invention.

Figure 8:
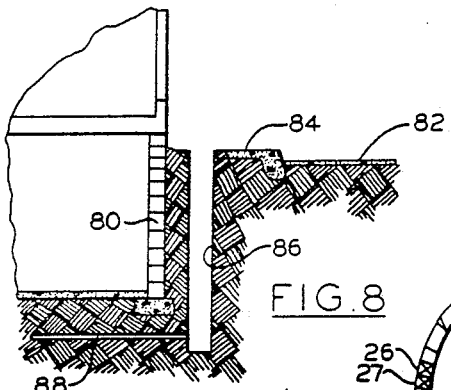

Referring then to FIG. 8, there is shown in fragmentary vertical section the foundation 80 of a building beneath which it is necessary to run a subterranean conduit. The building foundation is located close by roadway 82 and a sidewalk 84 which would need to be torn up and then repaired if conventional ramming techniques and equipment were to be employed. Using the present invention, it would be necessary only to dig a vertical shaft 86 having a diameter approximately 11 times that of horizontal tunnel 88 to be made. Normally this would be less than 30 inches.

Figure 9:
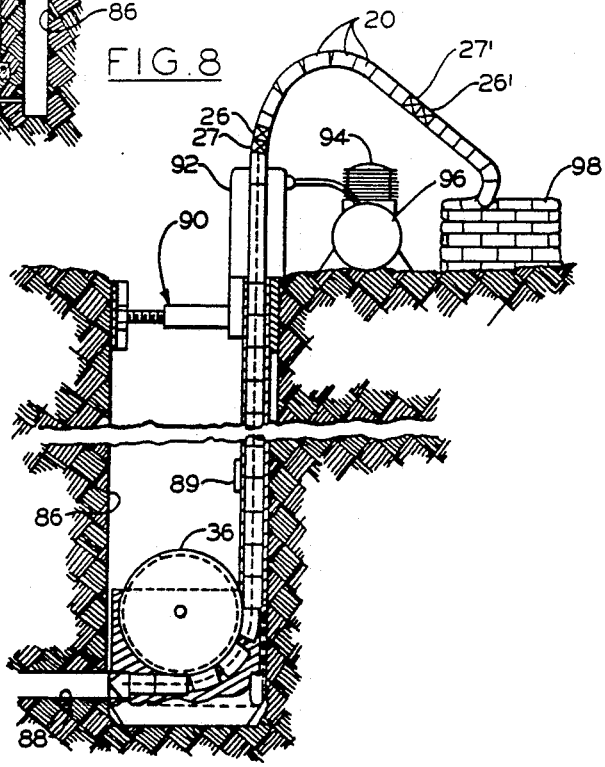
FIG. 9 depicts a portion of FIG. 8 with the particular embodiment of the invention adapted for use in such situations installed.

Referring to FIG. 9, a vertical shaft 86 such as that of FIG. 8 is shown on a larger scale with the tunneling apparatus according to the invention installed. The apparatus is similar to that shown in FIG. 1 and accordingly like parts are designated by like reference numerals. In the FIG. 9 embodiment the guide member portion 34 of the insertion tool 18 is shown to be made up of individual lengths of cylindrical tubing which are screwed or otherwise joined as at 89 in coaxial relation so that the guide member can be extended to whatever level is desired. A shorting jack 90 bridging the upper end of the shaft forces the upper end of the guide portion 34 against the sidewall of the shaft.

The upper end of the thrust rod 16 projects above ground level and is operatively engaged by a pneumatic piston driven cam jack 92. A source of compressed air such as a compressor 94 having an accumulator 96 pneumatically drives the cam jack in a rapid reciprocating motion. The jack grips the thrust rod on its downward stroke thrusting it vertically through the guide and corner block. On the return stroke, the cam jack releases the thrust rod. Thus repetitive strokes drive the nose piece into the sidewall creating horizontal tunnel 88. This process can then be reversed to withdraw the thrust rod and leave a tunnel through which utility lines can be passed.

While the invention as thus far described makes reference to the articulated rod as a unitary member (when the cable 22 is tensioned), to avoid an unwieldy projection of the rod above the surface as it is being thrust into the shaft, the elements 20 are preferably divided into convenient lengths by intermediate sets of collets, one such set being shown at 26', 27' in FIG. 9. These intermediate collets permit cable 22 to be tensioned in sections as the rod is advanced into the shaft. Thus, with continued reference to FIG. 9, the first section of the thrust rod 34 extending from nose piece 24 to collets 26, 27 is currently active, having been "integrated" or stiffened as described above. Beyond collets 26, 27 is a reserve length of untensioned cable with elements 20 strung thereon; the reserve length, including intermediate collets 26', 27, may be coiled as shown at 98 until needed, at which time the segment of cable 22 between collets 26, 27 and 26', 27' is tensioned in the manner already described.

Figure 10:
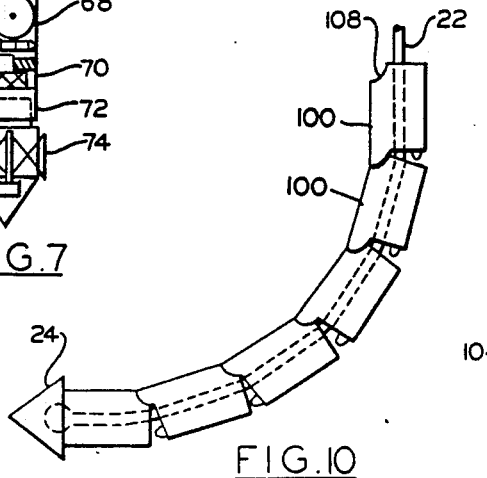
FIG. 10 is a diagrammatic illustration in side elevation of another embodiment of the invention having particular utility where very large thrusting forces are required.
Figure 11:
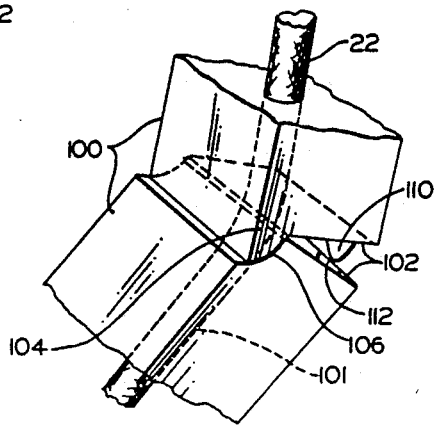
FIG. 11 is a segment of FIG. 10 on an enlarged scale and in perspective elevation.

The configuration of the elements 20 is one of the critical features of the invention. To achieve maximum stiffness of the articulated rod the distance from the centerline of the cable to the outer edge of the elements in the weakest bending axis is made as large as possible. The elements thus far described are circular in cross section; this has two important advantages: (1) the rod is equally stiff in all directions and (2) being bodies of revolution they are susceptible of automatic machine manufacture.

Where achieving maximum thrust load between the elements as they make the 90 degree bend in the corner block is an overriding consideration, elements 100 of quadrangular cross section as shown in FIGS. 10 and 11 may be preferred. Each element 100 is prismatic in form, a right rectangular parallelepiped being illustrated; it has a through bore 101 extending between centers of opposed faces 102. One end face has a ridge 104 extending along one edge of the face. The ridge has a part-cylindrical bearing surface 106, the central axis of which is coincident with or parallel to said edge.

The other end face of each element has a cylindrical groove 108 extending along the edge opposite the edge having ridge 104 and defining a bearing surface complementary to that on the ridge. When the elements are strung on cable 22 the respective bearing surfaces of adjoining elements are in surface contact. These elements require provision for shear transfer at the interface between them. This is accomplished in the illustrated embodiment by conical shear pins 110 at the corners opposite the cylindrical bearing surfaces at one end of the element and complementary conical recesses 112 in the other end surface.

The guide member 34 shown in FIG. 1 and described in conjunction with elements of circular cross section would have a counterpart (not shown) in the FIGS. 10 and 11 embodiment; it would of course be quadrangular in cross section.

What is claimed is:

1. In combination with apparatus for boring a primary shaft, an elongate articulated thrust rod for boring a secondary passage intersecting said shaft at substantially right angles at a subterranean location, said rod comprising:

(a) a plurality of substantially identical, generally tubular elements having complementary bearing surfaces at their respective ends, said elements, when in operative correlation, being disposed with said bearing surfaces in contact;

(b) a cable strung through said plurality of elements; and (c) means for securing said cable to the respective endmost elements and exerting a tensile force on said cable, the magnitude of said force being such as to maintain said elements in normally rigid coaxial relation to form the articulated rod while permitting flexure of the rod in response to an applied lateral force of sufficient magnitude.

2. The combination defined in claim 1 further comprising an insertion member adapted to be disposed at a selected location in said primary shaft, said member containing a 90 degree elbow-shaped passage having respective ends opening vertically upward and radially outward, said passage being configured and dimensioned to guidingly receive the lower end of the articulated rod thrust vertically downwward through said passage and cause flexure of said rod to conform to said 90 passage so that said one end emerges from said passage in a radially outward direction.

3. The combination defined in claim 2 wherein said elements and the passage in said insertion member are to circular cross section.

4. The combination defined in claim 2 wherein said elements and the passage in said insertion member are quadrangular in cross section.

5. The combination defined in claim 4, wherein said complementary bearing surfaces consist respectively of a rigid of substantially circular cross section along one edge of the tubular elements and a complementary recess along a diagonally opposite edge of the elements, the ridge of one of said elements being received in the recess of an adjacent element when the elements are disposed in operative correlation.

6. Apparatus for making a subterranean bore in the earth in general parallelism to the earth surface, comprising:

(a) an articulated rod made up of a plurality of substantially identical elements containing a through bore, the surfaces of said elements open to the ends of the through bore having complementary bearing surfaces, said elements, when in operative relation, being disposed with said complementary surfaces in contact and said through bores is normally coaxial alignment;

(b) a flexible cable passing through the bores in a plurality of said elements;

(c) a boring tool secured to one end of said cable, the ateral dimensions of said tool being equal to or greater than those of the through bores in said elements;

(c) cable gripping means adjacent the element most remote from said tool for exerting and maintaining a predetermined tensile force on said cable and concomitantly a compressive force on said plurality of elements to effectively integrate the elements to form said rod while permitting flexure of the rod in response to as applied lateral force;

(e) means drivingly coupled to said rod to impart axial thrusting force thereon; and (f) means for diverting said one end of the rod to a position orthogonal to the normal axis of the rod in response to said applied lateral force.

7. The combination defined in claim 3 wherein each of said elements is cylindrical in configuration and has a coaxial bore, the bearing surface at one end taking the form of an annular ridge concentric with the axis of the coaxial bore, the inner circumference of the ridge being substantially equal to the circumference of the bore and the outer circumference of the ridge being substantially smaller than the outer circumference of the element and being surrounded by a coaxial annular groove of arcuate cross section, the bearing surface at the other end of the element being formed by the outward flaring of the coaxial bore adjacent said other end terminating in a radius of approximately 135 degrees at the out circumference of said element.

8. The combination defined in claim 4 wherein each of said elements contains a through bore opening at opposed parallel end faces, one end face having a cylindrical ridge extending along one edge defined by the intersection of the end face and a side face of the element. The other end face having a complementary cylindrical recess extending along an edge opposite to said one edge.

9. A method of forming a subterranean passage extending substantially perpendicularly to and intersecting a shaft of greater cross section than the passage and open at the earth's surface, comprising:

(a) inserting into said shaft a tubular guide member of smaller cross section than the shaft and extending along one sidewall of the shaft from the surface to a point where the passage is desired the guide member terminating at said point in a 90 degree elbow;

(b) locking said guide member in position;

(c) inserting into said guide member a thrust rod nose piece at one end, said rod consisting of a plurality of substantially identical elements disposed in coaxial end to end relation and having strung therethrough a cable secured at one end to the nose piece;

(d) applying a tensile force to said cable at a point remote from said one end, imparting sufficient rigidity to the rod to permit thrusting the nose piece to create said passage and sufficient flexibility to enable the rod to negotiate the 90 degree elbow;

(e) locking said cable to one of said elements at said point to maintain tension therein; and (f) repetitively thrusting said rod to create said passage.

10. The method defined in claim 9 wherein:

(a) additional elements are strung on said cable;

(b) a tensile force is applied to said cable between said one point and a second point more remote from said one end of the cable; and (c) one of said elements is locked to the cable at said second point to maintain tension in the cable between said one point and said second point.

11. The method defined in claim 10 including the further step of inserting the cable tensioned between said one point and said second point and the elements strung thereon into the guide member and continuing the repetitive thrusting.

12. The method defined in claim 11 wherein said one element at said one point is unlocked from the cable after the cable is tensioned between said one point and second point and locked at said second point.

13. The method defined in claim 9 wherein said nose piece is of lesser cross section than the interior of said guide member and is inserted into the guide member from the remote from the 90 elbow.

14. The method defined in claim 9 wherein said nose piece is of greater cross section than the interior of said guide member and the untensioned cable with the elements strung thereon is inserted into the guide member from the end proximate said 90 degree elbow.

* * * * *